US006919843B2

(12) United States Patent
Tsai et al.

(10) Patent No.: US 6,919,843 B2
(45) Date of Patent: Jul. 19, 2005

(54) ANTENNA MODULE FOR A PORTABLE ELECTRONIC APPARATUS

(75) Inventors: Tiao-Hsing Tsai, Taipei (TW); Chien-Pin Chiu, Yun-Lin Hsien (TW)

(73) Assignee: Quanta Computer Inc., Tao-Yuan Hsien (TW)

( * ) Notice: Subject to any disclaimer, the term of this patent is extended or adjusted under 35 U.S.C. 154(b) by 13 days.

(21) Appl. No.: 10/751,285

(22) Filed: Dec. 30, 2003

(65) Prior Publication Data

US 2005/0007280 A1 Jan. 13, 2005

(30) Foreign Application Priority Data

Jul. 10, 2003 (TW) ..... 92118866 A

(51) Int. Cl.[7] ..... H01Q 1/38; H01Q 1/42
(52) U.S. Cl. ..... 343/700 MS; 343/702
(58) Field of Search ..... 343/702, 700 MS

(56) References Cited

U.S. PATENT DOCUMENTS 4,218,682 A * 8/1980 Frosch et al. ..... 343/700 MS
5,434,581 A * 7/1995 Raguenet et al. .... 343/700 MS
6,639,558 B2 * 10/2003 Kellerman et al. .. 343/700 MS
6,812,891 B2 * 11/2004 Montgomery et al. ..... 343/700 MS
6,819,293 B2 * 11/2004 De Graauw ..... 343/702
6,842,140 B2 * 1/2005 Killen et al. ..... 343/700 MS
6,862,002 B2 * 3/2005 Demicco et al. ..... 343/846

* cited by examiner

*Primary Examiner*—Don Wong
*Assistant Examiner*—Angela M. Lie
(74) *Attorney, Agent, or Firm*—Ladas & Parry LLP

(57) ABSTRACT

An antenna module includes a dielectric substrate mounted in a housing of a portable electronic apparatus and having a grounding layer that extends parallel to a mounting surface and that is connected electrically to first and second contacts on the mounting surface via first and second conductive vias formed in the substrate and extending from the mounting surface to the grounding layer, respectively. A radiating element is disposed on the mounting surface of the substrate and is connected electrically to the first contact. A conductive grounding member is mounted detachably on the mounting surface of the substrate, and has a first section that is connected electrically to the second contact, and a second section connected electrically to the first section and spaced apart from the radiating element in a direction transverse to the mounting surface of the substrate.

4 Claims, 3 Drawing Sheets

ANTENNA MODULE FOR A PORTABLE ELECTRONIC APPARATUS

CROSS-REFERENCE TO RELATED APPLICATION

This application claims priority of Taiwanese Application No. 092118866, filed on Jul. 10, 2003.

BACKGROUND OF THE INVENTION

1. Field of the Invention

This invention relates to an antenna module, more particularly to an antenna module for a portable electronic apparatus.

2. Description of the Related Art

Presently, a conventional antenna module for a portable electronic apparatus is grounded through a dielectric substrate of the portable electronic apparatus. In view of the current trend in the design of the portable electronic apparatus to be shorter, smaller, lighter and thinner, the decreased length of the dielectric substrate in the portable electronic apparatus has an adverse effect on a radiation gain of the conventional antenna module. For example, referring to FIG. 1, gain values (indicated by rhombic blocks in FIG. 1) of a conventional antenna module having a substrate with a length within a range from 60 mm to 130 mm at an operating frequency of 1850 MHz are shown, wherein the conventional antenna module having the substrate with the length of 90 mm has a radiation gain of −0.4 dBi.

SUMMARY OF THE INVENTION

Therefore, the object of the present invention is to provide an antenna module for a portable electronic apparatus that can provide an increased radiation gain.

According to the present invention, there is provided an antenna module for a portable electronic apparatus with a housing. The antenna module comprises:

a dielectric substrate adapted to be mounted in the housing and having a mounting surface formed with first and second contacts, the substrate further having a grounding layer that extends parallel to the mounting surface, the grounding layer being connected electrically to the first and second contacts via first and second conductive vias formed in the substrate and extending from the mounting surface to the grounding layer, respectively;

a radiating element disposed on the mounting surface of the substrate and connected electrically to the first contact; and a conductive grounding member mounted detachably on the mounting surface of the substrate, the grounding member having a first section that is connected electrically to the second contact such that the first section is connected electrically to the grounding layer via the second contact and the second conductive via, and a second section connected electrically to the first section and spaced apart from the radiating element in a direction transverse to the mounting surface of the substrate.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 4:
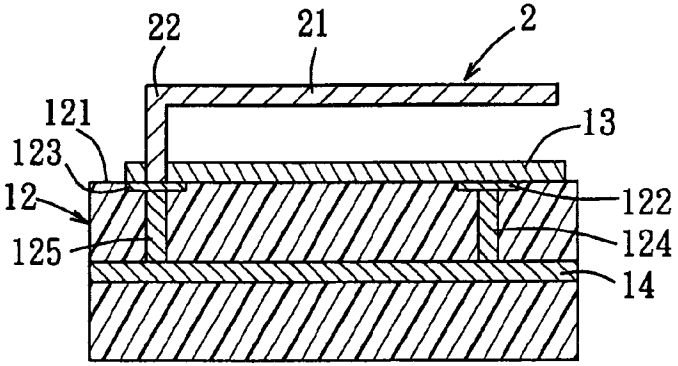
FIG. 4 is a schematic sectional view showing the first preferred embodiment.
Figure 3:
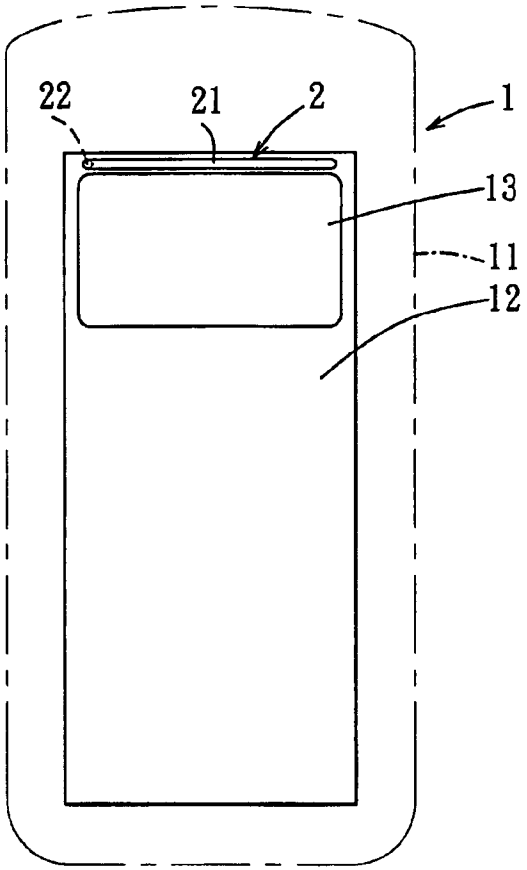
FIG. 3 is a schematic top view showing the first preferred embodiment.

Referring to FIGS. 3 and 4, the first preferred embodiment of an antenna module for a portable electronic apparatus 1, such as a mobile phone, a notebook computer or a personal digital assistant, according to the present invention enables the portable electronic apparatus 1 to execute wireless communication according to at least one of GSM (900 MHz) , DCS (1800 MHz) , PCS (1900 MHz), IEEE802.11b (2.4~2.4835 GHz) and IEEE802.11a (5.725~5.850 GHz). In this embodiment, the portable electronic apparatus 1 is a mobile phone and has a housing 11. The antenna module includes a dielectric substrate 12, a radiating element 13, and a conductive grounding member 2.

The substrate 12 is adapted to be mounted in the housing 11, and has a mounting surface 121 formed with first and second contacts 122, 123, as shown in FIG. 4. The substrate 12 further has a grounding layer 14 that extends parallel to the mounting surface 121. The grounding layer 14 of this embodiment is embedded in the substrate 12 and is connected electrically to the first and second contacts 122, 123 via first and second conductive vias 124, 125 formed in the substrate 12 and extending from the mounting surface 121 to the grounding layer 14, respectively.

The radiating element 13 is disposed on the mounting surface 121 of the substrate 12 and is connected electrically to the first contact 123, as best shown in FIG. 4.

The conductive grounding member 2 is mounted detachably on the mounting surface 121 of the substrate 12 in a known manner. The grounding member 2 has a first section 22 that is connected electrically to the second contact 123 such that the first section 22 is connected electrically to the grounding layer 14 via the second contact 123 and the second conductive via 125, and a second section 21 connected electrically to the first section 22 and spaced apart from the radiating element 13 in a direction transverse to the mounting surface 121 of the substrate 12, as best shown in FIG. 4. In this embodiment, the second section 21 is disposed parallel to the mounting surface 121 of the substrate 12, and is transverse to the first section 22. The grounding member 2 of this embodiment is a metal strip and is disposed adjacent to an upper side of the substrate 12.

Figure 1:
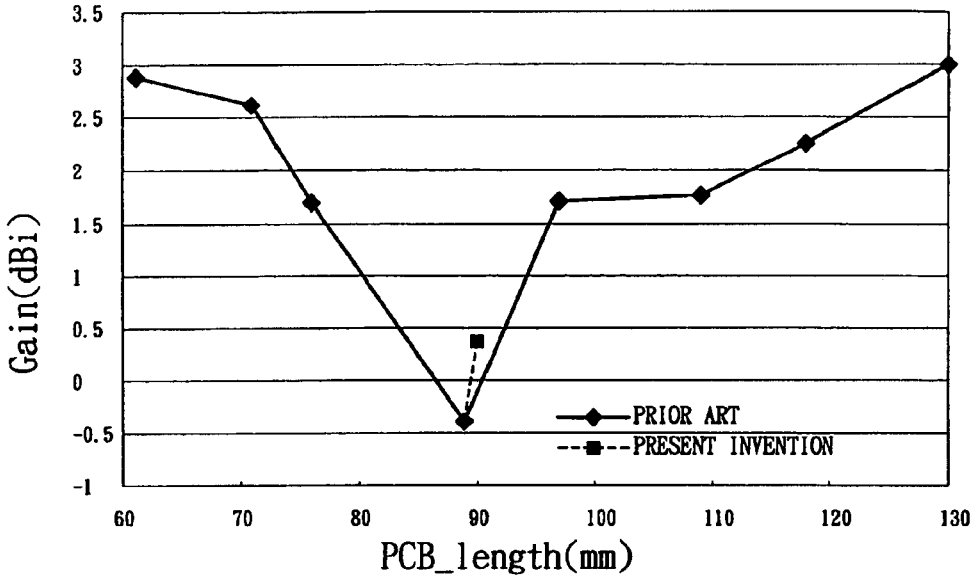
FIG. 1 shows gain values of a conventional antenna module having a substrate with a length within a range from 60 mm to 130 mm at an operating frequency of 1850 MHz and the first preferred embodiment of an antenna module having a substrate with a length of 90 mm according to the present invention.
Figure 2:
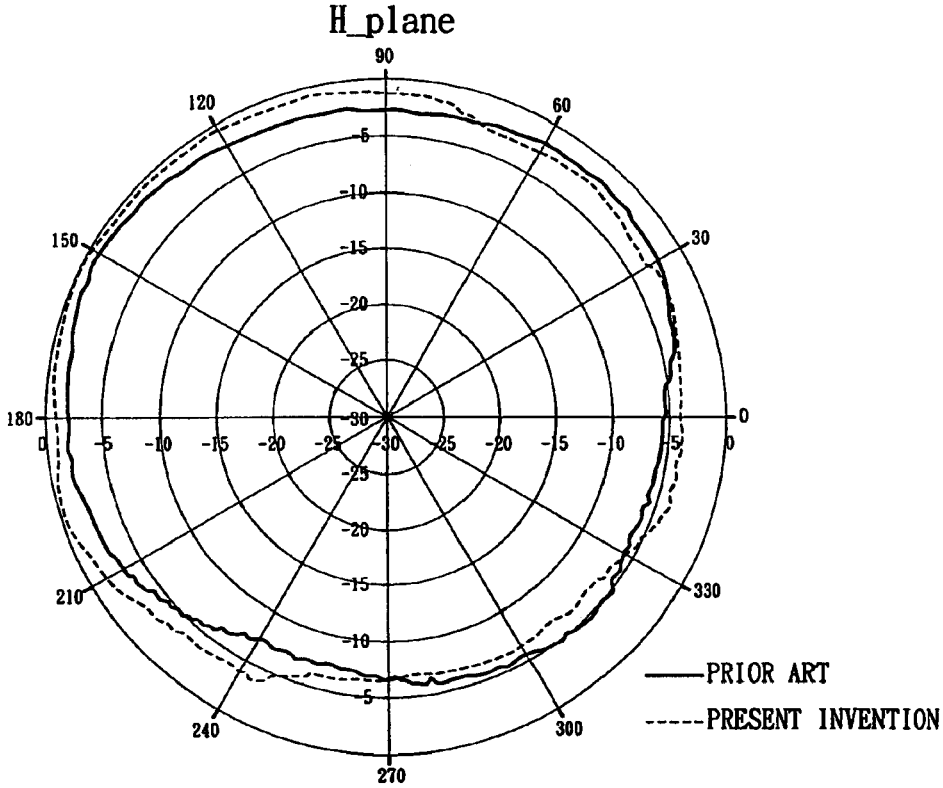
FIG. 2 shows radiation patterns of the conventional antenna module having the substrate with the length of 90 mm and the first preferred embodiment in a horizontal plane at an operating frequency of 1850 MHz.
Figure 5:
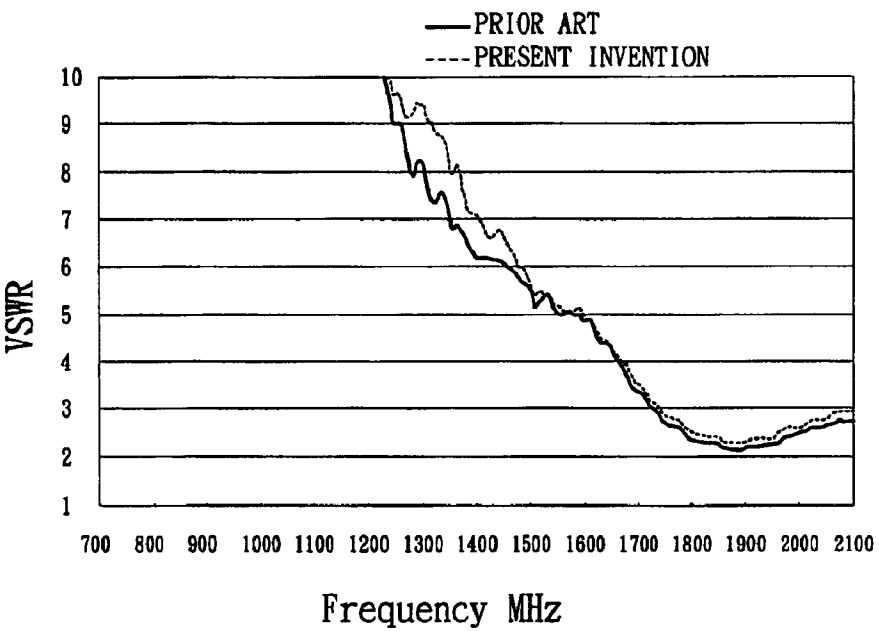
FIG. 5 is a plot showing VSWR charts of the first preferred embodiment and the conventional antenna module having the substrate with the length of 90 mm.

In this embodiment, for example, the substrate 12 has a length of 90 mm and the grounding member 2 has a length of 10 mm such that the antenna module of the present invention has a radiation gain of 0.35 dBi (indicated by a square block in FIG. 1) at an operating frequency of 1850 MHz, which is higher than that (−0.4 dBi) of the aforesaid conventional antenna module. Furthermore, the antenna module of the present invention has a radiation intensity in a horizontal plane at 1850 MHz (indicated by dotted lines in FIG. 2) greater than that of the aforesaid conventional antenna module (indicated by solid lines in FIG. 2). Moreover, the slightly increased voltage standing wave ratio (VSWR) for the antenna module of the present invention (indicated by dotted lines in FIG. 5 as compared to that for the aforesaid conventional antenna module still meets design requirements.

Figure 6:
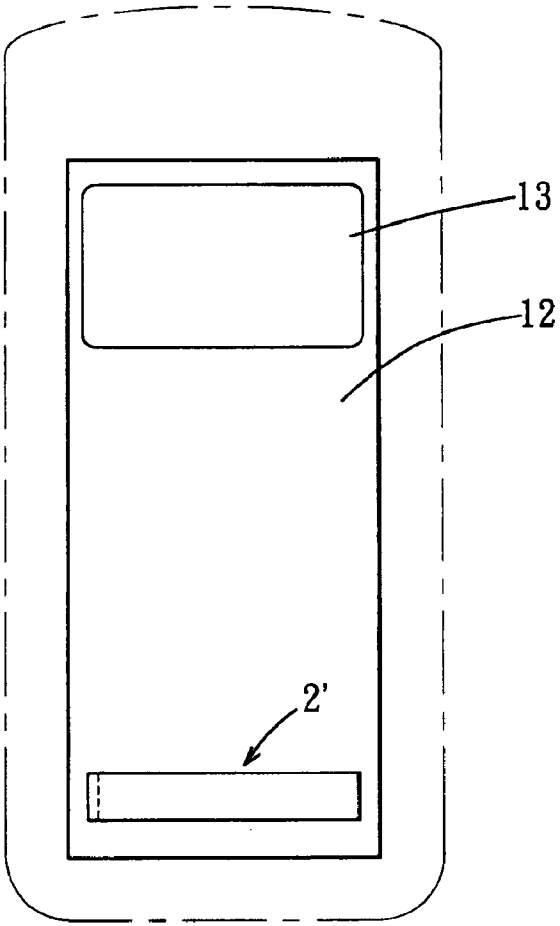
FIG. 6 is a schematic view showing the second preferred embodiment of an antenna module according to the present invention.

FIG. 6 illustrates the second preferred embodiment of an antenna module according to this invention, which is a modification of the first preferred embodiment. Unlike the embodiment of FIG. 3, the conductive grounding member 2' is a metal plate and is disposed adjacent to a lower side of the substrate 12.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An antenna module for a portable electronic apparatus with a housing, said antenna module comprising:

a dielectric substrate adapted to be mounted in the housing and having a mounting surface formed with first and second contacts, said substrate further having a grounding layer that extends parallel to said mounting surface, said grounding layer being connected electrically to said first and second contacts via first and second conductive vias formed in said substrate and extending from said mounting surface to said grounding layer, respectively;

a radiating element disposed on said mounting surface of said substrate and connected electrically to said first contact; and a conductive grounding member mounted detachably on said mounting surface of said substrate, said grounding member having a first section that is connected electrically to said second contact such that said first section is connected electrically to said grounding layer via said second contact and said second conductive via, and a second section connected electrically to said first section and spaced apart from said radiating element in a direction transverse to said mounting surface of said substrate.

2. The antenna module as claimed in claim 1, wherein said second section of said grounding member is disposed parallel to said mounting surface of said substrate, and is transverse to said first section.

3. The antenna module as claimed in claim 1, wherein said grounding member is a metal strip.

4. The antenna module as claimed in claim 1, wherein said grounding member is a metal plate.

* * * * *